US009055368B1

(12) United States Patent
Johnson et al.

(10) Patent No.: US 9,055,368 B1
(45) Date of Patent: Jun. 9, 2015

(54) SOUND IDENTIFICATION AND DISCERNMENT DEVICE

(75) Inventors: Anne M. Johnson, Bristol, RI (US); William R. D'Angelo, North Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 322 days.

(21) Appl. No.: 13/587,994

(22) Filed: Aug. 17, 2012

(51) Int. Cl.
*H04R 5/02* (2006.01)
*H04R 1/10* (2006.01)

(52) U.S. Cl.
CPC ..... *H04R 1/1083* (2013.01)

(58) Field of Classification Search
CPC ..... H04R 1/1033; H04R 1/1091; H04R 5/04; H04R 2420/09; H04R 25/00; H04R 1/1041; H04R 24/58; H04R 31/06; H04R 1/1016; H04R 1/10; H01R 24/58; H01R 31/06; H04M 1/6058; H04M 1/05; A42B 3/166; H03G 3/32; G11B 27/105
USPC ..... 381/71.6, 74, 94.2, 94.8, 57, 309, 311, 381/372, 327; 379/67.1; 341/139
See application file for complete search history.

(56) References Cited

U.S. PATENT DOCUMENTS

| | | | | |
|---|---|---|---|---|
| 7,903,826 | B2 * | 3/2011 | Boersma | 381/57 |
| 8,023,663 | B2 * | 9/2011 | Goldberg | 381/74 |
| 2007/0223717 | A1 * | 9/2007 | Boersma | 381/74 |
| 2010/0215198 | A1 * | 8/2010 | Ngia et al. | 381/309 |
| 2011/0116654 | A1 * | 5/2011 | Chan et al. | 381/94.8 |
| 2011/0206217 | A1 * | 8/2011 | Weis | 381/74 |
| 2012/0087511 | A1 * | 4/2012 | Lumsden et al. | 381/74 |

* cited by examiner

*Primary Examiner* — Vivian Chin
*Assistant Examiner* — Ubachukwu Odunukwe
(74) *Attorney, Agent, or Firm* — James M. Kasischke; Jean-Paul A. Nasser; Michael P. Stanley

(57) ABSTRACT

The disclosed invention provides the ability for an operator, such as a sonar watch stander, to pay attention to both ambient sounds and system audio sound simultaneously. Further, the disclosed invention allows an operator to hear information being disseminated in the immediate environment, while still maintaining full sonar audio capability. The present invention allows the operator to take advantage of the benefits of binaural processing.

17 Claims, 2 Drawing Sheets

SOUND IDENTIFICATION AND DISCERNMENT DEVICE

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None

BACKGROUND OF THE INVENTION (1) Field of the Invention

The present invention relates to an apparatus that allows an operator to hear information being disseminated in the immediate environment, while maintaining a full system audio capability; e.g. full sonar audio capability. More particularly, the apparatus relates to sound identification and discernment that provides ability of an operator to pay attention to both ambient sounds and system audio simultaneously. The apparatus of the present invention allows the operator the ability to take advantage of the human's natural binaural listening advantage known in the art.

(2) Description of the Prior Art

As used herein, headsets, earphones, microphones and other such listening devices are meant to represent transducers that convert one quantity into another quantity specifically when one of the quantities is electrical.

Currently, sonar operators must remove one side of their headset to hear conversations and discussions in their immediate environment. The removal of one side of the headset allows for environmental/conversational awareness, but eliminates the advantage of the human's natural binaural listening advantage. Accordingly, the operator suffers a decrement in the ability to listen to system audio such as radio communications or SONAR. The removal of one ear cup also precludes the use of 3-D and spatially aware audio technologies made available by the proper usage of headsets.

There are four basic types of headsets: (1) Circumaural earphones with or without passive noise isolating properties, (2) Behind-the-ear earpieces typically used for amplification, (3) Bud-earpieces commonly used for communications and music, and (4) Completely-in-the-canal self-contained amplification devices. Headsets can be used binaurally-both ears, and monaurally-one ear. The design and intended application of headsets can determine which method provides optimal use.

Current state of the market circumaural headsets utilize active noise cancellation (ANC) processes, allowing background, or ambient noise, to be reduced. Hearing aid and headset advances now include the use of Bluetooth and wireless connectability with televisions, phones, and other devices. Bluetooth is a term known in the art and represents a proprietary open wireless technology standard for exchanging data over short distances from fixed and mobile devices. In addition to Bluetooth, hearing aid technology includes advances in noise cancellations, miniaturization and other improvements to provide improved hearing for an operator, such as a sonar operator or Air Traffic Controllers.

SUMMARY OF THE INVENTION

Accordingly, it is an object of the present invention to provide a sound identification and discernment apparatus that integrates hearing-aid-like technology into a (sonar watchstander or Air Traffic Controller) headset.

Another object of the present invention is to allow the user to listen to non-system conversation in the local environment, but to give the option to the operator to toggle on/off a noise cancellation filter so as to focus on system audio, such as spatial 3-D auditory sonar signals.

It is a further object of the present invention to allow the operator of the sound identification and discernment system to be able to vary the ratio of ambient, environmental sound to system audio.

Still further, it is an object of the present invention to provide an active noise cancellation apparatus which essentially removes ambient, environmental sound, allowing full concentration on system audio.

Further still, it is an object of the present invention to allow the operator to utilize a pair of headsets with each headset remaining stationary on a respective ear of the operator to provide a binaural listening advantage, while still having the ability to pay attention to both the ambient sound and system audio simultaneously.

In accordance with the present invention, a sound identification and discernment apparatus is provided for both sonar operators and Air Traffic Controllers. The apparatus provides binaural listening, and all of the advantages thereof, for humans having a pair of ears. The apparatus comprises (a) a pair of transducers each serving as a headset and each having first and second inputs with the first input thereof receiving ambient sound input signals and the second input thereof receiving system audio input signals, each of the headsets remaining stationary on a respective ear of a human utilizing the apparatus. The apparatus further comprises (b) a processor receiving first and second signals with the first signal being representative of the ambient sound input signals and the second signal thereof being representative of the audio signals of the system. In addition, the processor receives an input that serves to adjust the ratio between these two input signals. The processor provides an output signal representative of both the first and second received signals in a ratio adjusted by the operator. The processor output signal is routed to at least each of the second inputs of each of the transducers.

BRIEF DESCRIPTION OF THE DRAWINGS

Other objects, features and advantages of the present invention will become apparent upon reference to the following description of the preferred embodiments and to the drawings, wherein corresponding reference characters and elements indicate corresponding parts throughout the several views of the drawings and wherein.

DETAILED DESCRIPTION OF THE INVENTION

Figure 1:
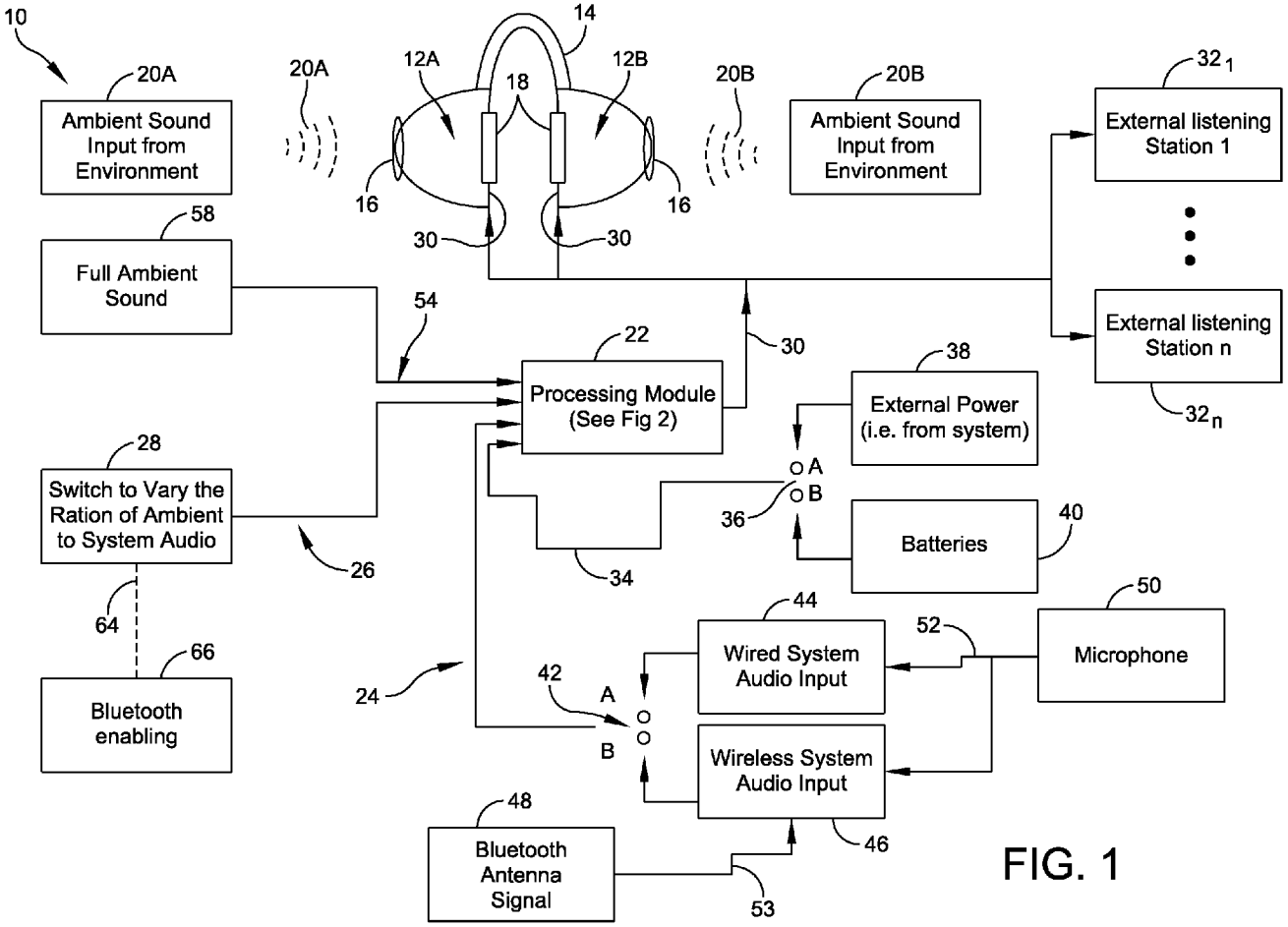
FIG. 1 is a block diagram of the sound identification and discernment device of the present invention.

Referring now to the drawings and more particularly to FIG. 1, there is shown a block diagram of the sound identification and discernment apparatus 10 in accordance with one embodiment of the present invention. The apparatus 10 comprises a pair of transducers 12A and 12B, each serving as the opposing halves of an audio headset. Each of the transducers 12A and 12B are designed for placing on the head of a human user such that transducer 12A covers and remains stationary on one of the ears of the user and transducer 12B covers and remains stationary on the other/opposite ear of the user utilizing the apparatus 10. In a preferred embodiment, the apparatus 10 is part of a larger audio system, such as a SONAR system. Working in conjunction with the SONAR system, apparatus 10 provides binaural listening, and all of the advantages thereof, for the user, which in a preferred embodiment is a sonar operator standing watch.

The pair of transducers 12A and 12B are interconnected by a headband 14 having interaural connections that provide control signals and power to the transducers, in a manner known in the art. Each of the transducers 12A and 12B comprises a microphone 16 and an earphone speaker 18 embedded in noise isolating material that will prevent sound surrounding the user to reach the user's ears when placed on the user's head.

The microphone 16 of the transducer 12A receives signal 20A representing ambient sound input from the environment and, similarly, microphone 16 of transducer 12B receives signal 20B which also represents sound input from the environment. Further, earphone speaker 18 of each of the transducers 12A and 12B allows sound to be passed to the ear of the operator utilizing apparatus 10. Earphone speaker 18 also allows SONAR system sound to be passed to the operator.

The apparatus 10 further includes a processing module 22 which receives at least first and second signals 24 and 26, with the first signal 24 being representative of the audio signals of the larger audio system and the second signal 26, being supplied by a device 28, being representative of a switch to adjust the ratio of ambient to system audio. The processor 22 generates an output signal 30, representative of both signals 24 and 26, and which is routed to each of the microphones 18 in each of the transducers 12A and 12B and also, preferably, to one or more external listening stations $\mathbf{32}_1 \ldots \mathbf{32}_n$.

The processing module 22 receives electrical power from bus 34 which is routed to a conventional switching device 36, having positions A and B that are respectively routed to external power source 38 and batteries 40. In one embodiment, the apparatus 10 utilization of one or more batteries 40 allows each of the transducers 12A and 12B to be wireless.

The first signal 24, representative of the audio signals of the system, is delivered to the processor 22 by way of a conventional switching device 42 having positions A, and B that are respectively connected to wired system audio input 44 and wireless system audio input 46. The wireless system audio input 46 receives a signal developed by a Bluetooth antenna 48, known in the art, by way of signal path 53. Each of the wired system audio input 44 and wireless system input 46 preferably receive an input from microphone 50 by way of signal path 52. In a preferred embodiment, the microphone 50 is a hydrophone that is part of a passive SONAR system.

The processor 22 receives a second signal 54 which is routed from a signal 58, representative of the ambient sound input from the environment.

The processor receives a third signal 26 from switch 28. The switch 28 is an operator switch with a slider/Mode Indicator, to provide the option for the selection of: Full Ambient/An adjusted ratio of Ambient to System Input/and Full System Input with Active Noise Cancellation. Further, switch 28 may be responsive to a control signal 64 generated by an arrangement of Bluetooth enabling device 66. The Bluetooth enabling device 66, as well as the generated control signal 64, is known in the art. The processing module 22 may be further described with reference to FIG. 2.

Figure 2:
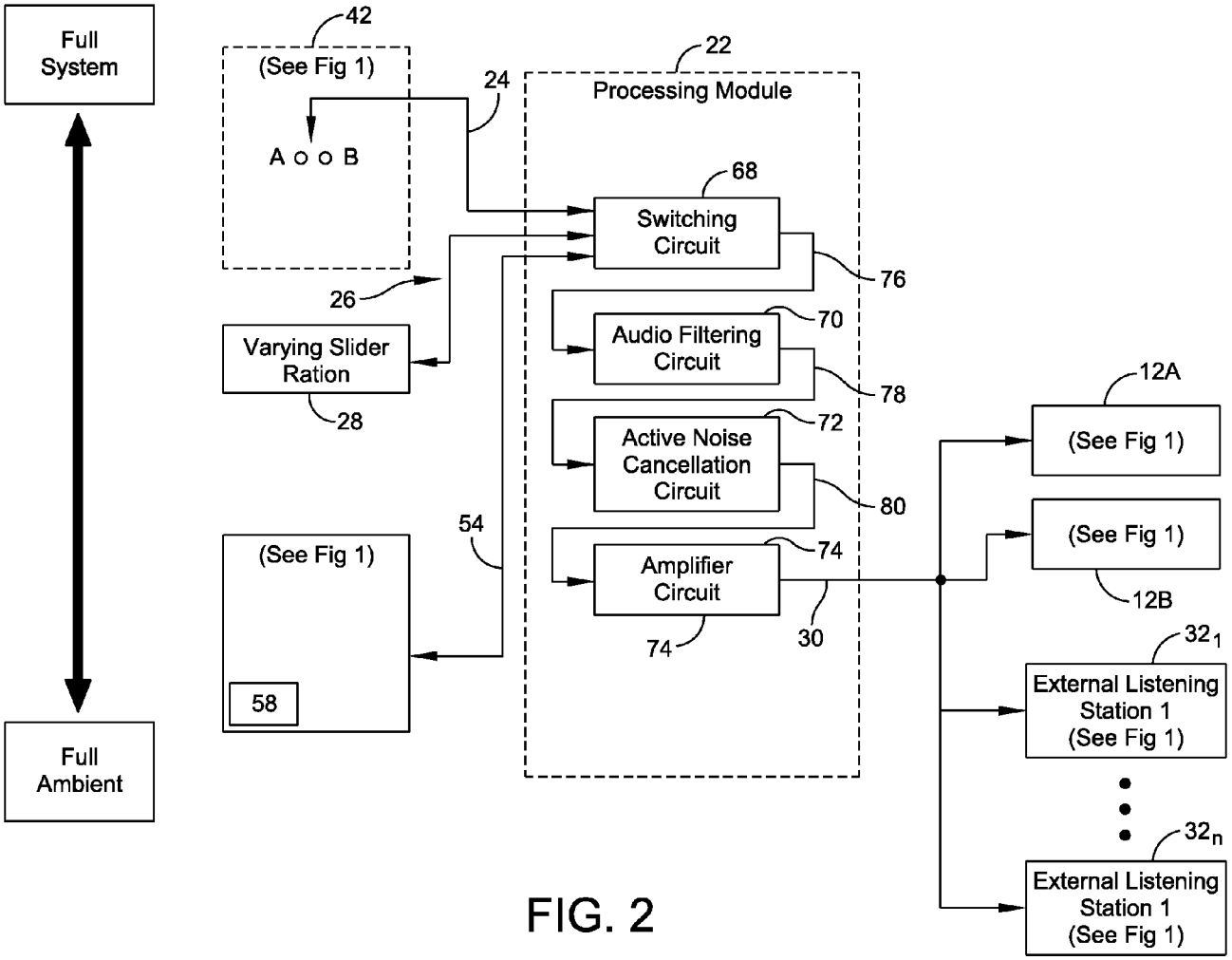
FIG. 2 is a block diagram illustrating details of the processing module of FIG. 1.

FIG. 2 illustrates the processing module 22 as comprised as a switching circuit 68, an audio filtering circuit 70, an active noise cancellation circuit 72, and an amplifier circuit 74. The switching circuit 68 adjusts the ratio of the first and second signals 24 and 54 based on signal 26 that indicates the position of the switch 28. Processing module 22 then provides a corresponding output 76 that is routed to the audio filtering circuit 70. The audio filters of the audio filtering circuit 70 are chosen to align with use; e.g., SONAR frequency bands, Communication Channels, and other parameters known in the art for operating SONAR systems.

The audio filtering circuit 70 receives the selected signal on path 76 providing an output signal on signal path 78 that is routed to the active noise cancellation circuit 72. The active noise cancellation circuit 72 cancels unwanted ambient sound from the environment (20A and 20B), in a manner known in the art, and provides an output to amplifier circuit 74, by way of signal path 80. The active noise cancellation circuit 72 is controlled by the position of the switch 28. The amplifier circuit 74 provides amplification levels that are limited to meet the standards, known in the art, for SONAR operation. The amplifier circuit 74, provides an output on signal path 30, previously discussed with reference to FIG. 1, that is routed to the pair of transducers 12A and 12B and the external circuits $\mathbf{32}_1 \ldots \mathbf{32}_n$.

In Operation

The apparatus 10 of the present invention integrates the use of active noise cancellation (element 72) and hearing aid audio filter technologies (element 70) as part of the audio interface for, in one embodiment, a sonar watch stander. The sonar watch stander has the transducers 12A and 12B on, or in, both ears so as to be provided with the benefits of binaural listening.

The apparatus 10 of the present invention captures ambient, environmental sound 20A and 20B, such as conversation. The ear cups or plugs (elements 12A and 12B) are connected to each other and to the sonar system, while allowing the operator to hear what is going on in the immediate area as well. The operator has the ability to hear surrounding conversations (element 58) mixed with filtered SONAR audio (element 24) thereby providing a spatially aware acoustic environment.

The apparatus 10 of the present invention allows audio input to be received from both the system of interest (for example, SONAR) and as ambient sound from the immediate environmental surroundings. Needed information can therefore be extracted from both inputs (system of interest and ambient sound), simultaneously, without having to remove an ear cup or earplug. The binaural hearing advantage is thereby maintained.

The user of the apparatus 10 may adjust a switch (element 28) to allow for audio filtering (element 70) and active noise cancellation (element 72) to emphasize the SONAR system audio input or to hear the apparatus 10 audio input combined with the ambient acoustic input (element 58). The processing module 22, based on the inputs 24, 26 and 54, performs the filtering (element 70), noise cancellation (element 72), and combinations of signals 24, 26 and 54, so as to provide an amplified output (element 74) that is routed to earphone speakers 18 of the transducers 12A and 12B.

It should now be appreciated that the practice of the present invention provides an apparatus 10 having the ability to pay attention to both ambient sounds and system audio simultaneously. The apparatus 10 allows the sonar watch stander to hear information being disseminated in the immediate environment, while maintaining full sonar audio capability. The apparatus 10 also allows the operator to take advantage of their inherent binaural processing ability. The new functionality provides clearer, more natural sounding audio. Because both earpieces (elements 12A and 12B) are always in use, the apparatus 10 allows the incorporation of 3-D, spatially aware audio technology.

It should be further appreciated that the practice of the present invention integrates hearing-aid-like technology into (sonar watch stander) headsets (elements 12A and 12B). This integration allows the user (sonar watch stander) to listen to non-system audio, i.e. conversations in the local environment, but is given the option to toggle on/off (element 28) a noise cancellation filter to focus on system (i.e. SONAR) audio (elements 24 and 72), such as spatial 3-D auditory sonar signals. The operator is able to vary (element 28) the ratio of ambient environmental sound to system audio. The active noise cancellation circuit (element 72) completely removes ambient, environmental sound and allows full concentration on system audio.

It should be further still appreciated that the practice of the present invention provides another embodiment by replacing signal and power input wiring with a Bluetooth antenna (element 48) and battery power (element 40). If platform requirements, governed by Bluetooth technology, allow, the wireless capability makes the headset (elements 12A and 12B) mobile.

Further still, the practice of the present invention provides an alternative embodiment that allows the "audio filtering/active noise cancellation" switch (element 28) to be Bluetooth (or similarly) enabled (elements 64 and 66).

Still further, the practice of the present invention provides an alternative embodiment that allows for the binaural output to the earpieces 18 (elements 12A and 12B) to be augmented by additional (not shown) spatial 3-D audio processing.

Moreover, the practice of the present invention provides an alternative embodiment that allows for the headset (elements 12A and 12B) to have the operator select from multiple communication channels, thus allowing the Commanding Officer (CO), Executive Officer (XO), Officer of the Deck (OOD), or others to be connected (elements $\mathbf{32}_1 \ldots \mathbf{32}_n$) to the system output (element 36) as desired.

In addition, the practice of the present invention provides an alternative embodiment that allows for other filtering (element 76) level needs, such as those desired for Air Traffic Controllers.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. A sound identification and discernment apparatus, that functions as part of and in conjunction with a SONAR system, that provides binaural listening for a SONAR operator, comprising:

a first transducer, made of noise isolating material, having a microphone capable of detecting ambient sound in the immediate environment surrounding the SONAR operator and having an earphone speaker for broadcasting sound into the SONAR operator's ear, wherein the first transducer remains stationary covering an ear of the operator;

a second transducer, electrically joined to the first transducer through a headband having interaural connections for control, signal and power, said second transducer being made of noise isolating material having a microphone capable of detecting ambient sound in the immediate environment surrounding the SONAR operator and having an earphone speaker for broadcasting sound into the SONAR operator's ear, wherein the second transducer remains stationary covering the other ear of the SONAR operator not covered by the first transducer;

a processor electrically joined to said first transducer and said second transducer receiving a plurality of electrical signals wherein a first signal is representative of the audio signals of said SONAR system in an adjustable ratio with a second signal representative of the ambient sound in the immediate environment surrounding the SONAR operator as detected by the microphones in the first and second transducers, said processor providing an output signal representative of the audio signals of said SONAR system and the ambient sound in the immediate environment surrounding the SONAR operator, said processor output signal being routed to each of said first transducers and said second transducers which in turn generate sound through the earphone speakers; and wherein said first signal received by said processor is provided by a switching means of said system, so as to be selectable from the group of signals representative of: (1) wired SONAR system audio input; and (2) wireless SONAR system audio input through a Bluetooth antenna signal.

2. The apparatus according to claim 1, wherein said output signal of said processor is further routed to at least one external listening station.

3. The apparatus according to claim 1, wherein said processor is powered by at least one battery interconnected to said processor by a first switching means.

4. The apparatus according to claim 1, wherein said processor receives said signals provided by a switching means, so as to be selectable from the group of signals representative of: full ambient sound, ambient sound with system input, and full system input with active noise cancellation.

5. The apparatus according to claim 4, wherein said switching means comprises a slider switch.

6. The apparatus according to claim 4, wherein said switching means is responsive to a Bluetooth enabling signal.

7. The apparatus according to claim 1, wherein said wired SONAR system audio input and said wireless SONAR system audio input are interconnected to a microphone.

8. The apparatus according to claim 1, wherein said processor comprises:

a switching circuit which switches between at least said first and second signals received by said processor, said switching circuit providing an output signal;

an audio filter circuit which receives said output signal of said switching circuit, said audio filter circuit providing an output signal;

an active noise cancellation circuit which receives said output signal of said audio filter circuit, said active noise cancellation circuit providing an output signal; and an amplifier circuit which receives said output signal of said active noise cancellation circuit, said amplifier circuit providing an output signal which serves as said output signal of said processor.

9. A method that provides binaural listening as part of and in conjunction with a SONAR system for a SONAR operator having a pair of ears comprising the steps of:

providing a pair of transducers each serving as a headset and each having first and second inputs with the first receiving ambient sound input signals, each of said headsets remaining stationary on a respective ear of a SONAR operator utilizing a system; and providing a processor for receiving first and second signals with the first signal thereof being representative of the audio signals of said SONAR system and the second signal thereof being representative of said ambient sound input signals, said processor providing an output signal representative of both said first and second received signals in an adjustable ratio, said processor output signal being routed to each of said second input of each of said transducers.

10. The method according to claim 9, wherein said output signal of said processor is further routed to at least one external listening station.

11. The method according to claim 9, wherein said processor is provided, so as to be powered by at least one battery interconnected to said processor by a first switching means.

12. The method according to claim 11, wherein said processor and said method further comprises providing second switching means, so as to be selectable from the group of signals representative of: (1) full ambient sound; (2) ambient sound with system input; and (3) full system input with active noise cancellation.

13. The method according to claim 12, wherein said provided second switching means comprises a slider switch.

14. The method according to claim 12, wherein said second provided switching means is responsive to a Bluetooth enabling signal.

15. The method according to claim 12, wherein said first signal received by said processor is provided by a third switching means of said system, so as to be selectable from the group of signals representative of: (1) wired system audio input; and (2) wireless system audio input through a Bluetooth antenna signal.

16. The method according to claim 15, wherein said wired system audio input and said wireless system audio input are interconnected to a microphone.

17. The method according to claim 9, wherein said provided processor comprises:

a switching circuit which switches between at least said first and second signals received by said processor, said switching circuit providing an output signal;

an audio filter circuit which receives said output signal of said switching circuit, said audio filter circuit providing an output signal;

an active noise cancellation circuit which receives said output signal of said audio filter circuit, said active noise cancellation circuit providing an output signal; and an amplifier circuit which receives said output signal of said active noise cancellation circuit, said amplifier circuit providing an output signal which serves as said output signal of said processor.

* * * * *